US010423121B2

(12) United States Patent
Shao et al.

(10) Patent No.: US 10,423,121 B2
(45) Date of Patent: Sep. 24, 2019

(54) DEVELOPING CARTRIDGE, PROCESSING CARTRIDGE, AND IMAGE FORMING APPARATUS

(71) Applicant: ZHUHAI PANTUM ELECTRONICS CO., LTD., Zhuhai (CN)

(72) Inventors: Zhe Shao, Zhuhai (CN); Haifei Gong, Zhuhai (CN); Chengjie Su, Zhuhai (CN)

(73) Assignee: ZHUHAI PANTUM ELECTRONICS CO., LTD., Zhuhai (CN)

( * ) Notice: Subject to any disclaimer, the term of this patent is extended or adjusted under 35 U.S.C. 154(b) by 0 days.

(21) Appl. No.: 16/259,839

(22) Filed: Jan. 28, 2019

(65) Prior Publication Data

US 2019/0171158 A1 Jun. 6, 2019

Related U.S. Application Data

(63) Continuation of application No. PCT/CN2017/095535, filed on Aug. 2, 2017.

(30) Foreign Application Priority Data

Aug. 8, 2016 (CN) ..... 2016 1 0643941
Aug. 13, 2016 (CN) ..... 2016 1 0666334
Aug. 13, 2016 (CN) ..... 2016 2 0877886 U

(51) Int. Cl.
*G03G 21/18* (2006.01)
*G03G 15/08* (2006.01)
*G03G 21/16* (2006.01)

(52) U.S. Cl.
CPC ..... *G03G 21/1864* (2013.01); *G03G 15/08* (2013.01); *G03G 21/16* (2013.01);
(Continued)

(58) Field of Classification Search
CPC ..... G03G 21/1647; G03G 21/1817; G03G 21/1821; G03G 21/1825; G03G 21/1842;
(Continued)

(56) References Cited

U.S. PATENT DOCUMENTS 9,317,004 B1 4/2016 Boettcher et al.
2013/0051844 A1* 2/2013 Shinoya ..... G03G 21/1842 399/111
(Continued)

FOREIGN PATENT DOCUMENTS

CN 201170841 Y 12/2008
CN 201170842 Y 12/2008
(Continued)

OTHER PUBLICATIONS

The World Intellectual Property Organization (WIPO) International Search Report for PCT/CN2017/095535 dated Nov. 7, 2017 6 Pages.

*Primary Examiner* — Sophia S Chen
(74) *Attorney, Agent, or Firm* — Anova Law Group, PLLC

(57) ABSTRACT

The present disclosure provides a developing cartridge, detachably mounted on a photosensitive drum cartridge which is detachably mounted inside an image forming apparatus and includes a drum holder and a photosensitive drum. At least one sidewall of the drum holder is provided with a supporting part. The developing cartridge includes a frame and a developing roller. At least one side-end surface of the frame is provided with a supported element. When the developing cartridge and the photosensitive drum cartridge are mounted, the supported element receives a force applied by a force-applying component of the image forming apparatus, such that the developing roller is maintained pressed against the photosensitive drum. The angle between the direction of the force and the normal direction of the contact
(Continued)

interface between the supported element and the supporting part is larger than or equal to the friction angle between the supported element and the supporting part.

14 Claims, 12 Drawing Sheets

(52) U.S. Cl.
CPC ..... *G03G 21/1647* (2013.01); *G03G 21/18* (2013.01); *G03G 21/1825* (2013.01); *G03G 2221/1884* (2013.01)

(58) Field of Classification Search
CPC ..... G03G 21/1864; G03G 2221/1884; G03G 21/16; G03G 21/18; G03G 15/08
See application file for complete search history.

(56) References Cited

U.S. PATENT DOCUMENTS

| | | | | |
|---|---|---|---|---|
| 2016/0170371 | A1 | 6/2016 | Kubo | |
| 2016/0349699 | A1* | 12/2016 | Miyamoto ..... | G03G 21/1821 |
| 2017/0269504 | A1* | 9/2017 | Abe ..... | G03G 21/1821 |

FOREIGN PATENT DOCUMENTS

| | | | |
|---|---|---|---|
| CN | 201194071 | Y | 2/2009 |
| CN | 201222169 | Y | 4/2009 |
| CN | 201820074 | U | 5/2011 |
| CN | 105549361 | A | 5/2016 |
| CN | 106154789 | A | 11/2016 |
| CN | 206039150 | U | 3/2017 |

* cited by examiner

DEVELOPING CARTRIDGE, PROCESSING CARTRIDGE, AND IMAGE FORMING APPARATUS

This application is a continuation application of International Application No. PCT/CN2017/095535, filed on Aug. 2, 2017, which claims the priority and benefits of Chinese Patent Application Nos. CN201610643941.6, filed on Aug. 8, 2016, CN201610666334.1, filed on Aug. 13, 2016, and CN201620877886.2, filed on Aug. 13, 2016, the entire content of all of which is incorporated herein by reference.

FIELD OF THE DISCLOSURE

The present disclosure relates to the field of image forming device technology and, more particularly, relates to a developing cartridge, a processing cartridge, and an image forming apparatus.

BACKGROUND

An image forming apparatus is an apparatus capable of forming text and images on a printing medium. For an image forming apparatus using a photo-imaging method, a processing cartridge is the most important component. A photosensitive component in the processing cartridge can convert image information into an electronic latent image, and then convert the electronic latent image into a solid toner image and transfer the toner image to the print medium. The processing cartridge contains toner, and as the printing operation continues, the toner is gradually consumed. Therefore, the processing cartridge is a consumable item and needs to be replaced frequently.

Currently, the common processing cartridges on the market include undetachable cartridges and detachable cartridges. Replacing an undetachable cartridge requires the user to re-purchase a processing cartridge or add toner to the processing cartridge. However, in practice, when the toner is consumed, the lifetime of the photosensitive component may still not be reached, so re-adding the toner may be the only thing needed in order to continue the use. However, for users, adding the toner may be very inconvenient, and may easily cause pollution. Therefore, with the current emphasis of environmental protection, using detachable cartridges becomes more favored.

Although the detachable type processing cartridge is more convenient to use, during the design process, the requirements on the matching accuracy between different parts may be higher. In particular, for a developing roller in the developing cartridge and a photosensitive drum in the photosensitive drum cartridge, if the clamping effect between the developing roller and the photosensitive drum is not sufficiently ensured, the printed image may have a significant quality problem. The conventional detachable type processing cartridges and image forming apparatuses are provided with a pushing component for respectively providing forces in two different directions to push the developing cartridge such that the developing roller can be maintained in contact with the photosensitive drum, and also press the processing cartridge such that the mounting of the processing cartridge in the image forming apparatus becomes more stable. According to the existing technology, in order to resist the rotational torque generated when the photosensitive drum rotates and the thrust force of the photosensitive drum against the developing roller and also prevent the developing cartridge from being retracted back in the mounting direction, the thrust force for pushing the developing cartridge is set to be relatively large. However, this may cause the processing cartridge to be partially subjected to a relatively large counterforce of the thrust force, and the resin frame of the processing cartridge may be deformed if there is no sufficient strength to support. In addition, if the thrust force is set to be too small, the clamping force between the developing roller and the photosensitive drum may be too small, which may affect the print quality and cause blurred images.

BRIEF SUMMARY OF THE DISCLOSURE

In view of the above problems, the present disclosure provides a developing cartridge, a processing cartridge, and an image forming apparatus, which provide a reasonable thrust force by a simple pushing component to realize the function for pushing the developing cartridge and the processing cartridge.

In order to solve the above problems, the technical solution adopted by the present disclosure includes the following aspects.

The present disclosure provides a developing cartridge. The developing cartridge is detachably mounted on a photosensitive drum cartridge, and the photosensitive drum cartridge is detachably mounted inside an image forming apparatus. The developing cartridge includes a frame and a developing roller mounted on the frame. The image forming apparatus further includes a force-applying component for applying a force to the developing cartridge. The photosensitive drum cartridge includes a drum holder and a photosensitive drum mounted on the drum holder, and at least one sidewall of the drum holder is provided with a supporting part for mounting the developing cartridge. At least one side-end surface of the frame of the developing cartridge is provided with a supported element cooperating with the supporting part. When the developing cartridge and the photosensitive drum cartridge are mounted inside the image forming apparatus, the supported element receives a force applied by the force-applying component, such that the developing roller is maintained pressed against the photosensitive drum. The angle between the direction of the force and the normal direction of the contact interface between the supported element and the supporting part is larger than or equal to the friction angle between the supported element and the supporting part.

The direction of the force applied by the force-applying component is toward the mounting direction of the developing cartridge.

The supporting part has a flat surface or a curved surface.

The developing cartridge includes a storage unit disposed on the bottom portion of the frame. A driving gear is mounted on an axial end of the developing roller. The storage unit, the driving gear, and the supported element are located on the same side of the developing cartridge, and when the developing cartridge is viewed from a direction perpendicular to the axis of the developing roller, the storage unit is overlapped with at least a portion the driving gear.

The developing cartridge further includes a guided section disposed on the at least one side-end surface of the frame. The storage unit, the driving gear, the guided section, and the supported element are located on the same side of the developing cartridge.

When the guided section is viewed from a direction parallel to the axis of the developing roller, the guided section is overlapped with at least a portion of the developing roller.

The developing cartridge further includes an end cap disposed at an end of the developing cartridge. The guided section and the supported element are disposed on the end cap. When the developing cartridge is viewed from a direction perpendicular to the axis of the developing roller, the storage unit, the driving gear, and the end cap are at least partially overlapped with each other.

The present disclosure provides a processing cartridge. The processing cartridge is detachably mounted inside an image forming apparatus, and includes a photosensitive drum cartridge and a developing cartridge. The photosensitive drum cartridge includes a drum holder and a photosensitive drum mounted on the drum holder, and at least one sidewall of the drum holder is provided with a supporting part for mounting the developing cartridge. The developing cartridge is configured to be detachably mounted on the drum holder, and includes a frame and a developing roller mounted on the frame. At least one side-end surface of the frame is provided with a supported element cooperating with the supporting part of the photosensitive drum. When the processing cartridge is mounted inside the image forming apparatus, the supported element receives a force applied by a force-applying component in the image forming apparatus, such that the developing roller is maintained pressed against the photosensitive drum. The angle between the direction of the force and the normal direction of the contact interface between the supported element and the supporting part is not less than the friction angle between the supported element and the supporting part.

A support wall is disposed on the bottom portion of each sidewall of the drum holder. The support wall is located under the supporting part, and when the processing cartridge is mounted inside the image forming apparatus, the support wall abuts against a direction-guiding section disposed inside the image forming apparatus.

A position-limiting protrusion is disposed at the front end of each sidewall of the drum holder. The position-limiting protrusion has a circular ring shape and is arranged concentrically with the axis of the photosensitive drum.

The present disclosure also provides an image forming apparatus. The image forming apparatus includes a main body, in which a direction-guiding section is disposed, and a processing cartridge that is detachably mounted on the main body along the direction-guiding section. The processing cartridge includes a photosensitive drum cartridge and a developing cartridge. The photosensitive drum cartridge includes a drum holder and a photosensitive drum mounted on the drum holder. At least one sidewall of the drum holder is provided with a supporting part for mounting the developing cartridge. The developing cartridge is detachably mounted on the drum holder, and includes a frame and a developing roller mounted on the frame. At least one side-end surface of the frame is provided with a supported element cooperating with the supporting part. A force-applying component is disposed in the main body for applying a force to the developing cartridge. When the processing cartridge is mounted on the main body, the developing roller is maintained pressed against the photosensitive drum. The angle between the direction of the applied force and the normal direction of the contact interface between the supported element and the supporting part is not less than the friction angle between the supported element and the supporting part.

A support wall is disposed on the bottom portion of each sidewall of the drum holder and under the supporting part. A support groove cooperating with the support wall is disposed on the direction-guiding section.

A support bevel abutting against the support wall is disposed on the bottom portion of the support groove.

When the processing cartridge is viewed from a direction perpendicular to the axis of the photosensitive drum, the supported element is overlapped with at least a portion of the support wall.

According to one of the design concepts of the present disclosure, a force is applied to the supported element by the force-applying component, and the angle between the direction of the applied force and the normal direction of the contact interface between the supported element and the supporting part is not less than the friction angle between the supported element and the supporting part. As such, it is possible to prevent undesired effects, such as deformation, breakage, etc., caused by the processing cartridge being under excessively large local stress.

According to another design concept of the present disclosure, a force is applied to the supported element by the force-applying component, and the storage unit, the driving gear, and the supported element are disposed on the same side of the developing cartridge. When the developing cartridge is viewed from a direction perpendicular to the axis the developing roller, the storage unit is overlapped with at least a portion the driving gear, such that the force applied to the storage unit and the driving gear is as close as possible to the pressing force applied by the force-applying component to the supported element, and thus the rotational torque generated on the processing cartridge is reduced. As such, the thrust force applied by a force-applying component to the processing cartridge can be reduced, and thus it is possible to prevent undesired effects, such as deformation, breakage, etc., caused by the processing cartridge being under excessively large local stress.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the disclosure, which are illustrated in the accompanying drawings. Wherever possible, the same reference numbers will be used throughout the drawings to refer to the same or like parts.

A Structure of the Image Forming Apparatus

Figure 1:
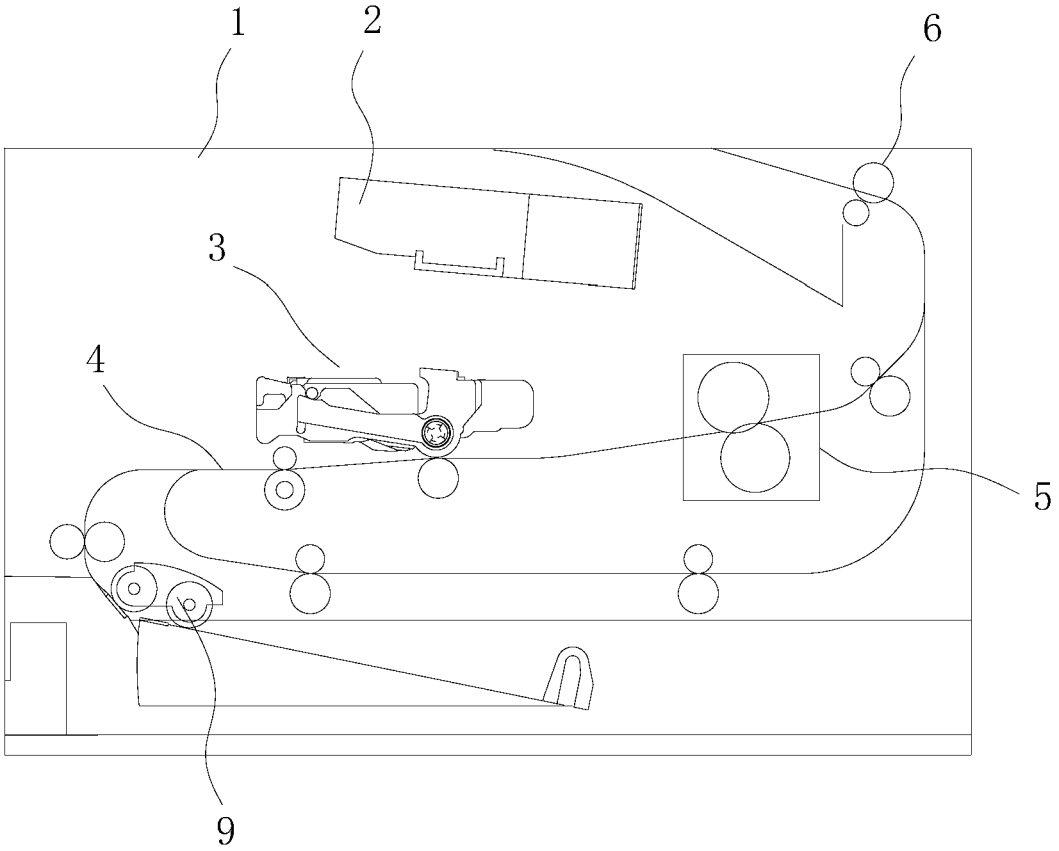
FIG. 1 illustrates a schematic structural view of an image forming apparatus according to some embodiments of the present disclosure.
Figure 2:
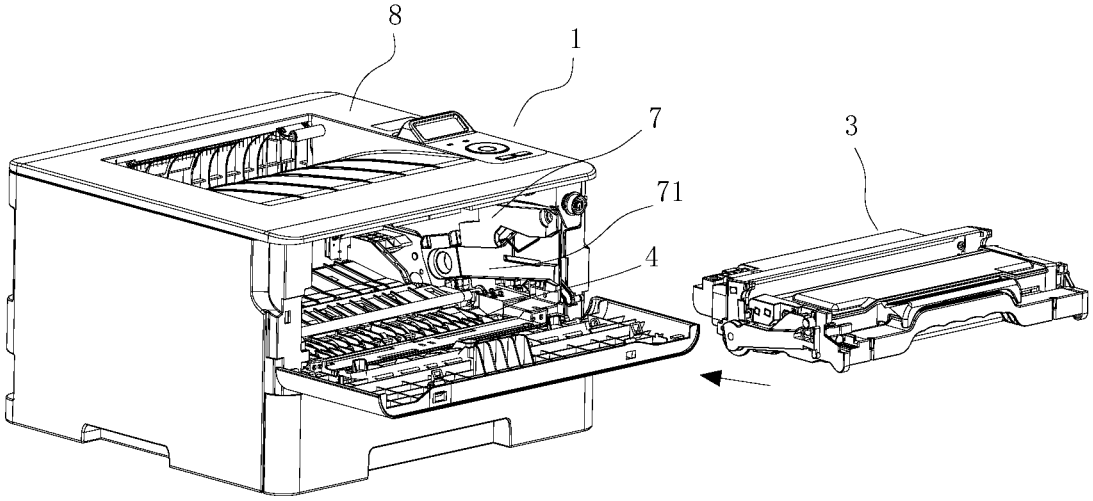
FIG. 2 illustrates a schematic diagram of the installation of a processing cartridge and an image forming apparatus according to some embodiments of the present disclosure.

Referring to FIGS. 1-2, an image forming apparatus 1 may include an image forming unit, a paper feed unit 9, a transport unit 4, an image-fixing unit 5, and a discharge unit 6. In the image forming process, a paper sheet may be output from the paper feed unit 9 and transported to the image forming unit by the transport unit 4; the image forming unit may convert the image information into an electrostatic latent image, and further convert the electrostatic latent image into a toner image; after the toner image is transferred to the paper sheet, the paper sheet may be transferred to the image-fixing unit 5 by the transport unit 4; after the paper sheet that carries the toner image is heated and pressed by the image-fixing unit 5, the toner image may be fixed on the paper sheet; after the completion of the image-fixing operation, the paper sheet may be finally discharged from the image forming apparatus 1 through the discharge unit 6.

Each of the above functional units may be mainly mounted and fixed by the frame of the image forming apparatus 1, i.e. by a main body 7 of the image forming apparatus 1. In one embodiment, the main body 7 may include two metal frames: a left metal frame and a right metal frame. Each functional unit may be assembled between the two metal frames, and the exterior of the main body 7 may be covered by a resin shell 8.

A Structure of the Processing Cartridge

Referring to FIGS. 1-4, the image forming unit may include an exposer 2 and a processing cartridge 3. The exposer 2 may be steadily mounted on the main body 7. The processing cartridge 3 can be freely mounted inside or removed from the image forming apparatus. The processing cartridge 3 may include a photosensitive drum cartridge 31 and a developing cartridge 32.

The photosensitive drum cartridge 31 may include a cylindrical photosensitive drum 33 and a drum holder 34 for supporting and mounting the photosensitive drum 33. The exposer 2 may form an electrostatic latent image corresponding to image information on the surface of the photosensitive drum 33 using laser beams. Both ends of the photosensitive drum 33 may be mounted on the drum holder 34 and may be rotatable after the installation. A charging roller 37 and a cleaning component may be further provided around the photosensitive drum 33.

The developing cartridge 32 may be used to store toner, and may be detachably mounted on the drum holder 34. The developing cartridge 32 may include a frame 35, and a number of structures such as a toner discharging blade 36, a rotatable developing roller 39, a stirring frame, a toner feeding roller 38, etc. may be mounted inside the frame 35. When the developing cartridge 32 is mounted on the photosensitive drum cartridge 31, the developing roller 39 and the photosensitive drum 33 may be in contact with other, and the driving component on the processing cartridge 3 may drive the developing roller 39 and the photosensitive drum 33 to rotate simultaneously. The toner inside the developing cartridge 32 may be adhered to the developing roller 39, and by the adjustment of the toner discharging blade 36, the toner may be transferred to the surface of the photosensitive drum 33 that carries the electrostatic latent image at a certain thickness and quantity, thereby forming a toner image on the surface of the photosensitive drum 33.

After the toner image is transferred to the paper sheet, the remaining toner on the surface of the photosensitive drum 33 may be removed by the cleaning component to keep the surface of the photosensitive drum 33 clean for the next cycle of the image forming operation. The paper sheet after the completion of the image forming operation may be transferred to the image-fixing unit 5 by the transport unit 4.

A Structure of the Photosensitive Drum Cartridge

Figure 3:
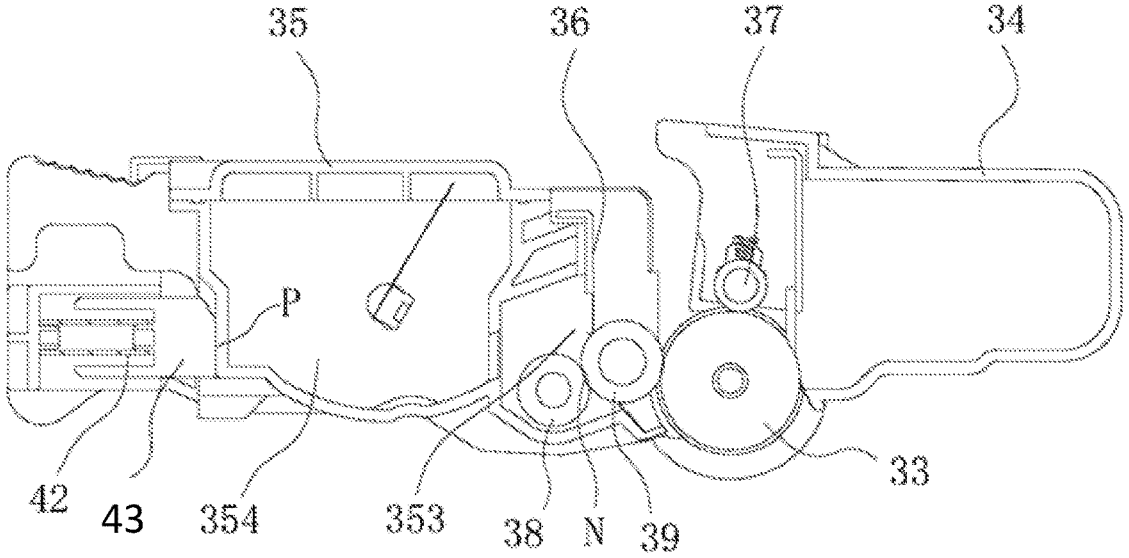
FIG. 3 illustrates a schematic cross-sectional view of an internal structure of a processing cartridge according to some embodiments of the present disclosure.
Figure 4:
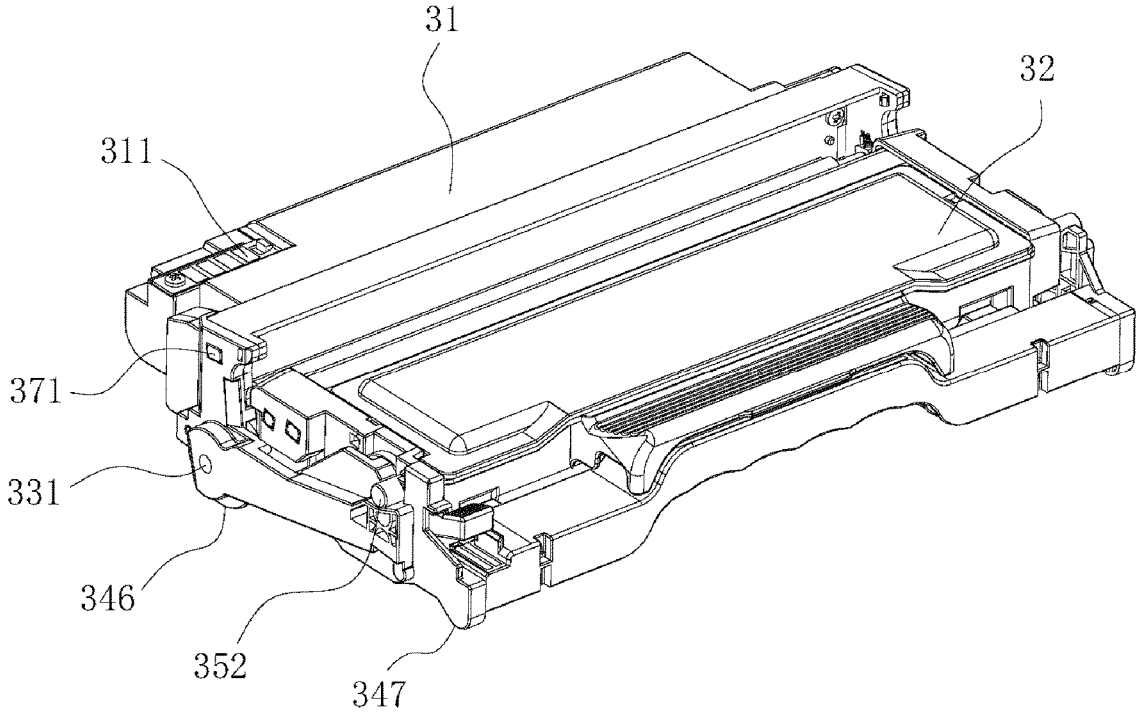
FIG. 4 illustrates a schematic view of an overall structure of a processing cartridge according to some embodiments of the present disclosure.
Figure 5:
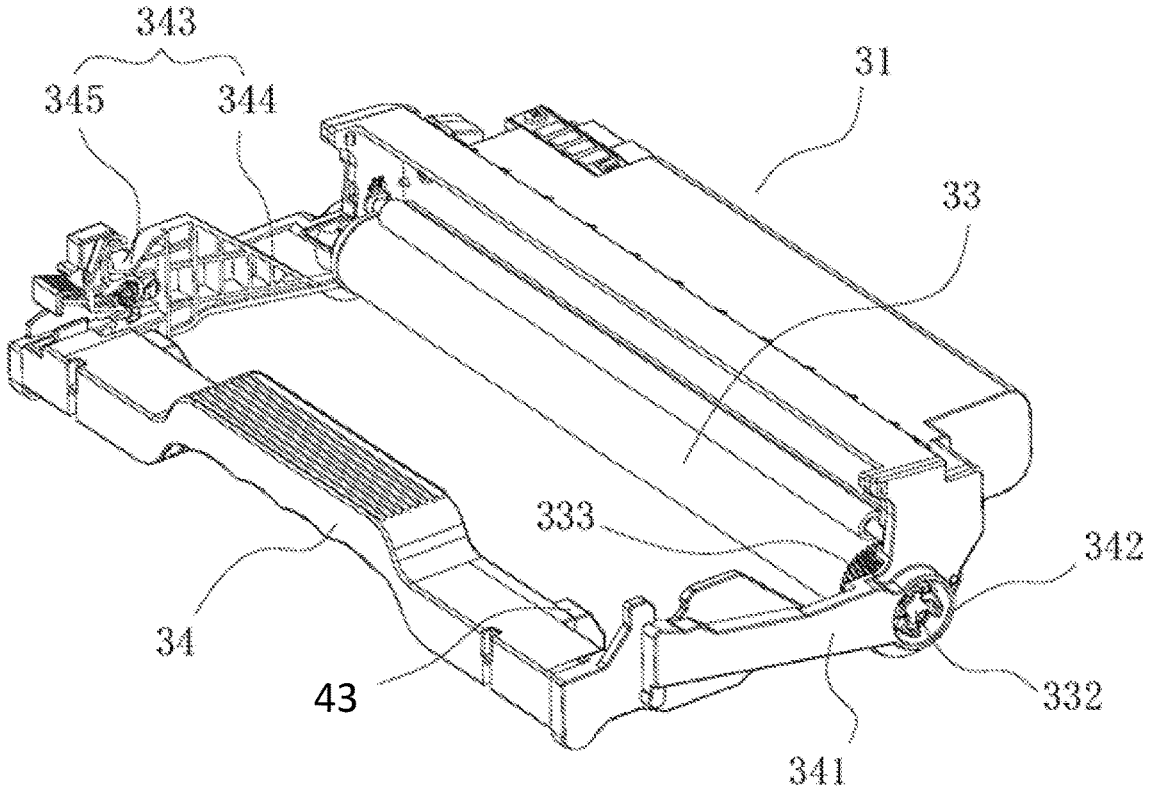
FIG. 5 illustrates a schematic structural view of a photosensitive drum cartridge according to some embodiments of the present disclosure.

Referring to FIGS. 3-5, two drum sidewalls 341 may be disposed on the two ends of the drum holder 34, respectively. The rear end of the drum holder 34 may be provided with a drum rear wall for connecting the two drum sidewalls 341, and the front end of the drum holder 34 may be provided with a waste-toner box for storing the waste toner. The two ends of the waste-toner box may be connected to the two drum sidewalls 341, respectively. The storage unit, the charging roller 37, and a cleaning blade may be mounted on the waste-toner box. The two ends of the photosensitive drum 33 may be mounted between the two drum sidewalls 341, and the photosensitive drum 33 may be freely rotatable around its own axis. The two ends of the photosensitive drum 33 may both be exposed to the outside of the photosensitive drum cartridge 31. One end of the photosensitive drum 33 may be provided with a photosensitive drum bias contact 331 to transfer static electricity on the surface of the photosensitive drum 33 to the main body 7 of the image forming apparatus 1, and the other end of the photosensitive drum 33 may be a driving end used to receive the driving force from one side of the main body 7 and also transfer the driving force to other moving components, such as the developing roller 39, the stirring frame, etc. in the processing cartridge 3.

The driving end of the photosensitive drum 33 may be provided with a photosensitive drum driving head 332 coaxial with the photosensitive drum 33. The photosensitive drum driving head 332 may be used to connect the main-body driving head on one side of the image forming apparatus 1, and receive the driving force. The photosensitive drum driving head 332 and the rear end of the main-body driving head may be respectively provided with claw-shaped protrusions that engage with each other. The photosensitive drum driving head 332 may also include a photosensitive drum driving gear 333 that is integrally formed and concentric therewith. The photosensitive drum driving gear 333 may be used to engage with other components in the processing cartridge 3, such as the developing roller driving gear 392, etc. for power transfer.

The movement of the main-body driving head may be interacted with the rotation of the front cover. When the front cover of the image forming apparatus 1 is closed, the main-body driving head may extend from the main body into the photosensitive drum cartridge 31, and may be coupled to the photosensitive drum driving head 332 to transfer the driving force. On the contrary, when the front cover of the image forming apparatus 1 is opened, the main-body driving head may be detached from the photosensitive drum cartridge 31 and separated from the photosensitive drum driving head 332, such that the processing cartridge 3 can be pulled out from the image forming apparatus 1.

A position-limiting protrusion 342 with a circular ring shape may be disposed at an outer front end of each drum sidewall 341, and a concave direction-guiding section 71 may be disposed on each of the inner sidewalls of the main body 7. The position-limiting protrusion 342 may extend out from the side surface of the processing cartridge 3 and may be disposed concentrically with the photosensitive drum 33, such that as shown in FIG. 2, during the process of mounting the processing cartridge 3 to the image forming apparatus 1, the position-limiting protrusion 342 can abut against the inner wall of the direction-guiding section 71 and slide into the image forming apparatus 1 along the direction-guiding section 71. As such, the attachment and removal of the processing cartridge 3 may become smooth.

The drum sidewall 341 may be provided with one or more guiding grooves 343 for guiding the installation of the developing cartridge 32, and the guiding groove 343 may be provided with a guiding section 344 and a supporting part 345, respectively cooperating with the guided section 351 and the supported element 352 disposed at the side-end surface of the developing cartridge 32. The number of the guiding grooves 343 can be set to one or two. When the number of the guiding groove 343 is one, the guiding section 344 may be located at a downstream position in the mounting direction of the developing cartridge 32, and the supporting part 345 may be located at an upstream position in the mounting direction of the developing cartridge 32. According to the present disclosure, the number of the guiding grooves 343 may be two, and the two guiding grooves 343 may be disposed side by side in a front-rear configuration. The guiding section 344 may be located on the front guiding groove 343 that is closer to the photosensitive drum 33, and the supporting part 345 may be located on the rear guiding groove 343 that is further away from the photosensitive drum 33. The supporting part 345 may have a flat surface or a curved surface. In the following, a detailed description of the structure of the supporting part 345 will be provided.

When the processing cartridge 3 is not mounted inside the image forming apparatus 1, or when the developing cartridge 32 needs to be replaced, the processing cartridge 3 is generally placed on the table by the user, and the photosensitive drum 33 may easily rub and collide against the tabletop, causing damages and finally affecting the print quality. To prevent the photosensitive drum cartridge 31 from being damaged, four support columns may be respectively disposed at the four corner positions of the bottom portion of the photosensitive drum cartridge 31. In one embodiment, the four support columns may be disposed on the bottom portion of the drum sidewall 341, and among them, the two front support columns 346 located at the front side of the photosensitive drum cartridge 31 may be disposed under the axial end of the photosensitive drum 33. In another embodiment, the two rear support columns 347 located at the rear side of the photosensitive drum cartridge 31 may be disposed on the drum rear wall.

Further, in the horizontal direction, the heights of the two rear support columns 347 at the rear side may be preferably set to be lower than the heights of the two front support columns 346. With this arrangement, when the processing cartridge 3 is placed on the table top, the front side of the processing cartridge 3 may be upturned with respect to the rear side, and the front side of the developing cartridge 32 may also be tilted with respect to the rear side in accordance with the posture that the processing cartridge 3 is placed. As such, the toner outlet 353 of the developing cartridge 32 will be placed in an upward posture, and thus the toner stored in the developing cartridge 32 may not gather at the toner outlet 353, but may gather toward the rear side of the developing cartridge 32. Therefore, the toner may not be easily leaked to the outside of the developing cartridge 32 from the toner outlet 353, and thus pollution may be avoided.

As shown in FIG. 3, in order to press the developing cartridge 32 to keep the developing roller 39 in contact with the photosensitive drum 33, a pushing component may be provided at the rear side of the photosensitive drum cartridge 31, and the pushing component may include a slider 43 mounted on the drum holder 34. The slider 43 may be able to slide in a direction perpendicular to the direction of the axis of the photosensitive drum 33. A push spring 42 may also be mounted on the drum holder 34, and the push spring 42 may push the slider 43 to slide toward the developing cartridge 32, forcing the developing roller 39 in contact with the photosensitive drum 33 to ensure the print quality. Further, in order to ensure the developing cartridge 32 receiving a relatively stable thrust force, the front pushing surface P of the slider 43 may be configured to be flat, and correspondingly, the pushing surface at the rear side of the developing cartridge 32 may also be configured to be flat. Moreover, in the moving direction of the pushing component, the projection of the clamping interface N between the developing roller 39 and the photosensitive drum 33 may be located within the range of the pushing surface P described above, or may be under the pushing surface P described above. In the present disclosure, "under" may refer to a direction indicated by the downstream position in the mounting direction of the developing cartridge 32.

A Structure of the Developing Cartridge

Figure 6:
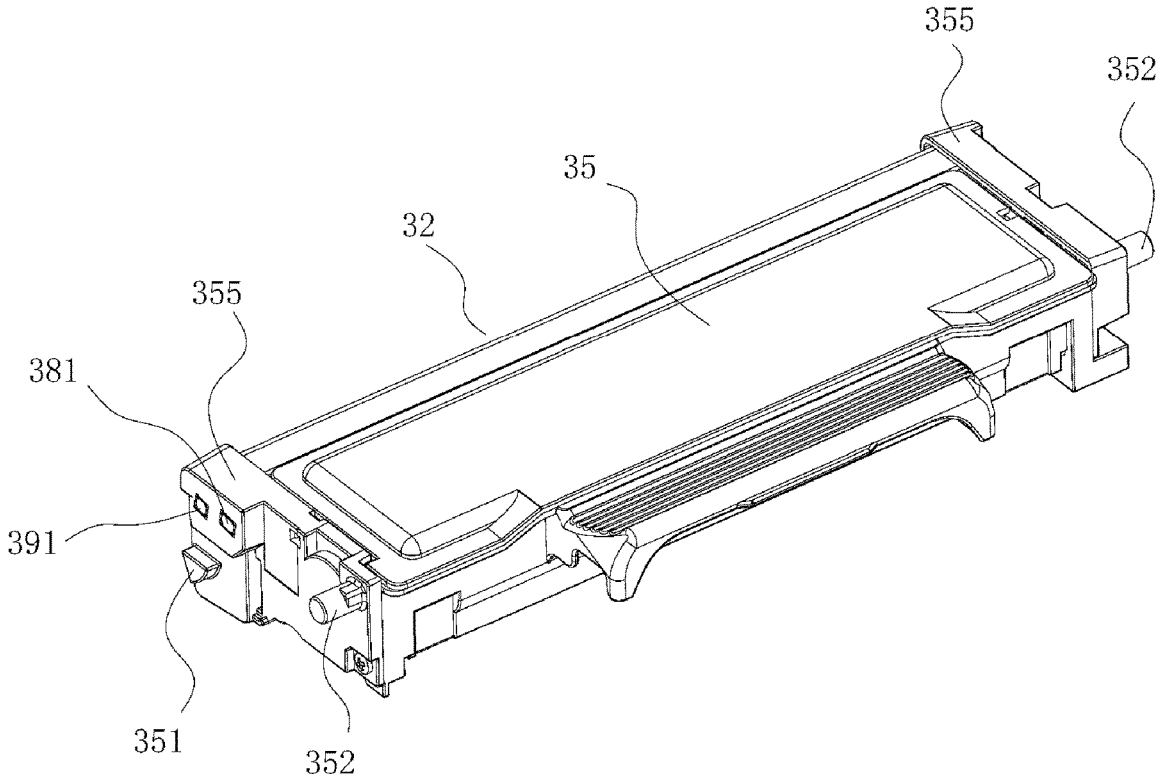
FIG. 6 illustrates a schematic structural view of a developing cartridge according to some embodiments of the present disclosure.

Referring to FIGS. 3-4 and FIG. 6, the main part of the developing cartridge 32 may include a frame 35 made of resin. The frame 35 may have a square structure with a toner outlet 353 disposed on the front side while the other sides are closed. As such, a cavity 354 capable of containing toner may be formed. Sealing structures may be provided between the toner outlet 353 and the frame 35, between the toner outlet 353 and the developing roller 39, and between the toner outlet 353 and the toner discharging blade 36 to prevent toner from leaking. A stirring frame may be disposed in the cavity 354 to stir the toner in the cavity 354, and also move the toner toward the toner outlet 353. A toner feeding roller 38, a developing roller 39, and a toner discharging blade 36 may be disposed at the toner outlet 252. The two ends of each of the toner feeding roller 38 and the developing roller 39 may be mounted on the frame 35, and the toner feeding roller 38 and the developing roller 39 can freely rotate on the frame 35. The toner discharging blade 36 may be mounted on the frame using screws. The toner feeding roller 38 and the toner discharging blade 36 may both be in contact with the developing roller 39, such that the toner feeding roller 38 is able to transfer the toner to the developing roller 39. The toner discharging blade 36 may be able to scrape off the excess toner on the surface of the developing roller 39 to limit the output amount of the toner.

Figure 7:
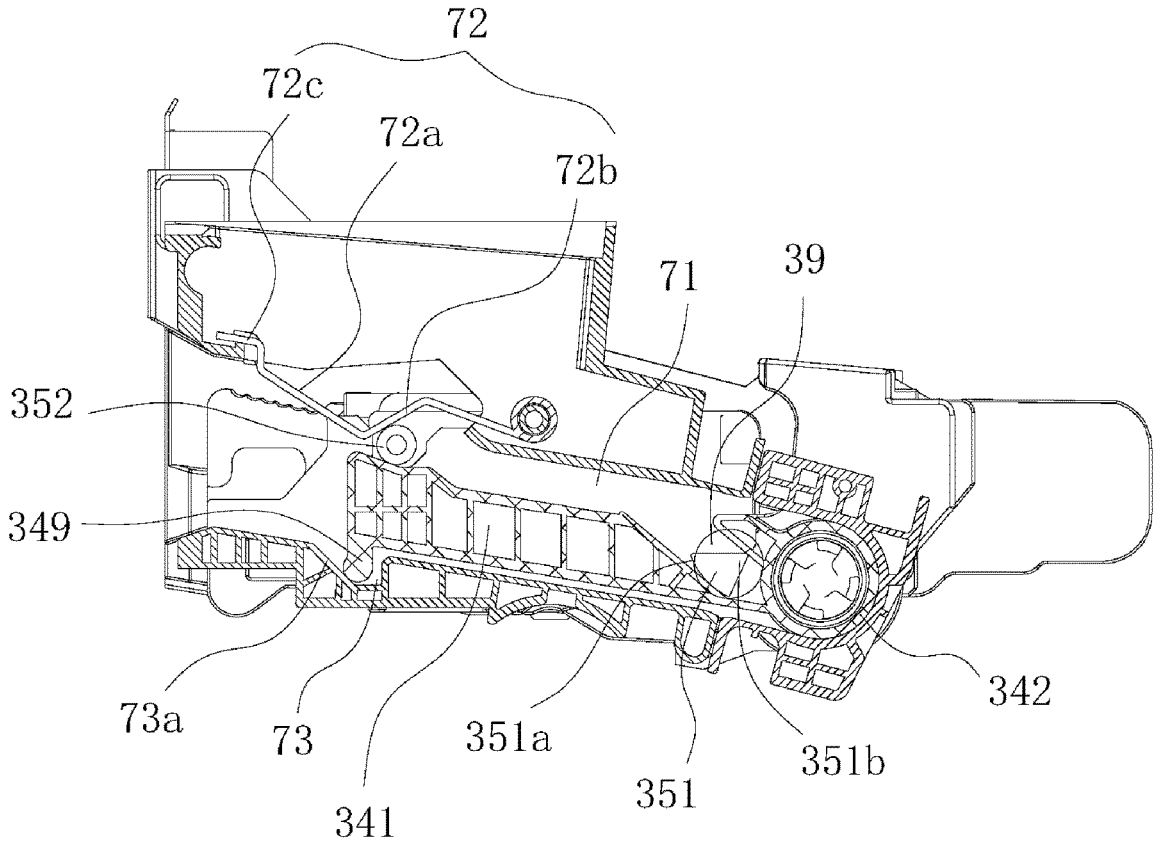
FIG. 7 illustrates a schematic cross-sectional view of an image forming apparatus in a direction perpendicular to the axis of a photosensitive drum and passing through a supported element according to some embodiments of the present disclosure.
Figure 8:
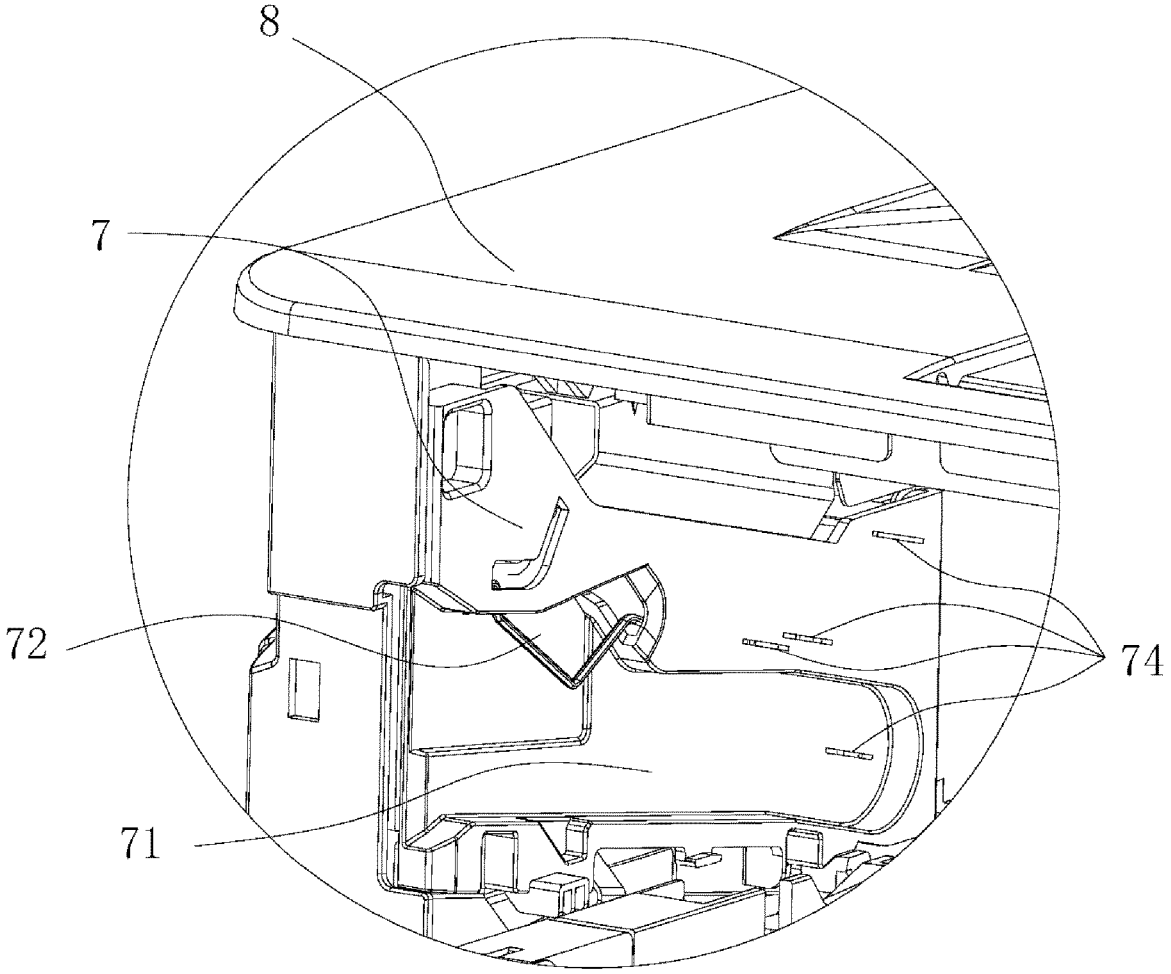
FIG. 8 illustrates a schematic structural view of a left-side direction-guiding section inside an image forming apparatus according to some embodiments of the present disclosure.
Figure 9:
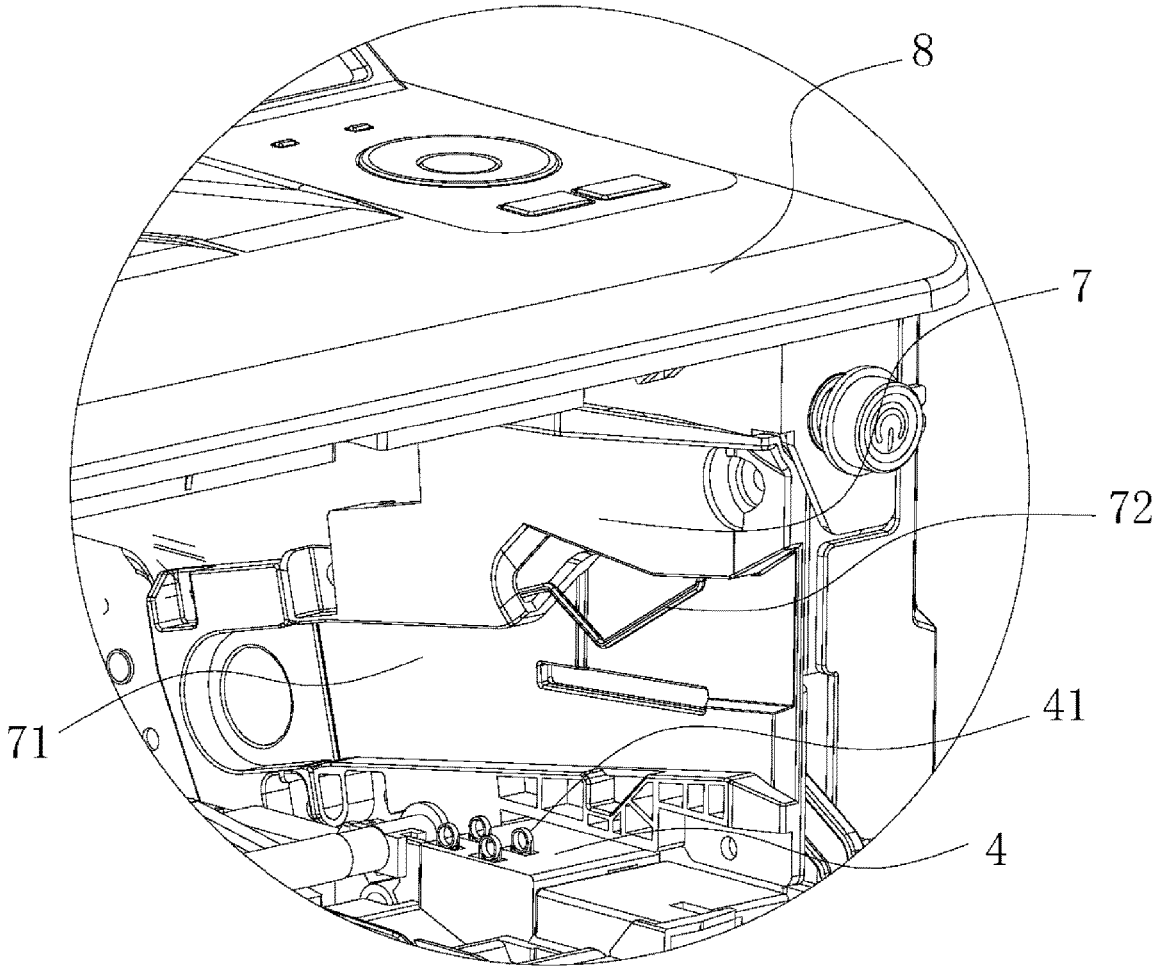
FIG. 9 illustrates a schematic structural view of a right-side direction-guiding section inside an image forming apparatus according to some embodiments of the present disclosure.

Referring to FIG. 7, a supported element 352 and a guided section 351 may be disposed on the side-end surface of the frame 35 to respectively cooperate with the supporting part 345 and the guiding section 344 that are located on the photosensitive cartridge 31. The guided section 351 may be disposed at a position closer to the developing roller 39. Preferably, when the guided section 351 is viewed from a direction parallel to the axial direction of the developing roller 39, the guided section 351 may be overlapped with a portion of the developing roller 39 so as to be as close as possible to the developing roller 39. When the guided section 351 is provided to have a cylindrical shape, the guided section 351 may be disposed concentrically with the developing roller 39. In this case, the axial end of the developing roller 39 may be used as the guided section 351 or the guided section 351 may be an additional part placed on the axial end of the developing roller 39. When the guided section 351 has a non-cylindrical shape, it may be required to at least provide one guiding surface 351*a* to make contact with the surface of the guiding section 344 and one position-limiting end 351*b* to limit the displacement of the guided section 351 in the guiding groove 343, such that after the developing cartridge 32 is mounted on the photosensitive drum cartridge 31, the developing cartridge 32 may be prevented from moving.

In one embodiment, the supported element 352 and the guided section 351 may be integrally molded with the frame 35 by injection molding. Alternatively, the axial end of the developing roller 39 may be used as the guided section 351. In another embodiment of the present disclosure, an end cap 355 may be mounted on at least one side end of the frame 35. The end cap 355 may be fixed to the frame 35 by a buckle or a screw. The supported element 352, the guided section 351, and the end cap 355 may be integrally molded by injection molding. Similarly, the guided section 351 may be disposed as close as possible to the developing roller 39, such that after the developing cartridge 32 is mounted to the photosensitive drum cartridge 31, the forces applied on the developing cartridge 32 may be more stable.

A Conductive Structure of the Processing Cartridge

In one embodiment, as the photosensitive drum 33, the charging roller 37, the developing roller 39, and the toner feeding roller 38 are disposed in the processing cartridge 3, according to the imaging principle of a laser printer, the charging roller 37, the developing roller 39, and the toner feeding roller 38 may all need to be applied with a certain amount of voltage. The static electricity on the photosensitive drum 33 may need to be transferred to the main body 7 of the image forming apparatus 1, and therefore, the processing cartridge 3 may be provided with a plurality of bias contacts electrically connected to a plurality of bias contacts 74 disposed in the main body 7. Referring to FIGS. 8-9 and FIGS. 1-6, a plurality of bias contacts 74 may be disposed in the main body 7, and accordingly, a plurality of bias contacts may be disposed on the processing cartridge 3 to electrically connect the plurality of bias contacts 74. The plurality of bias contacts disposed on the processing cartridge 3 may include a charging roller bias contact 371 (referring to FIG. 4), a developing roller bias contact 391 (referring to FIG. 6), a toner feeding roller bias contact 381 (referring to FIG. 6), and a photosensitive drum bias contact 331 (referring to FIG. 4).

In order to facilitate the circuit layout of the image forming apparatus 1, the contacts mentioned above may be disposed on the same side of the processing cartridge 3. In one embodiment, the bias contacts of the processing cartridge 3 may be arranged in a manner such that the photosensitive drum bias contact 331 and the charging roller bias contact 371 may be located on the sidewalls of the drum holder 34, and the developing roller bias contact 391 and the toner feeding roller bias contact 381 may be disposed on one of the side-end surfaces of the frame 35. Preferably, on the path along which the processing cartridge 3 is mounted inside the image forming apparatus 1, the photosensitive drum bias contact 331 and the charging roller bias contact 371 may be located closer to the downstream position than the developing roller bias contact 391 and the toner feeding roller bias contact 381.

Moreover, in a vertical plane, the photosensitive drum bias contact 331 and the charging roller bias contact 371 may be located on the two sides of the moving path of the developing roller bias contact 391 and the toner feeding roller bias contact 381, respectively. Further, the developing roller bias contact 391 may be located closer to the downstream position than the toner feeding roller bias contact 381. As such, in the process of mounting the processing cartridge 3 to the image forming apparatus 1, the bias contacts 74 that are disposed on the sidewalls of the main body 7 and correspond to the four bias contacts on the processing cartridge 3, respectively may not scrape the other non-corresponding bias contacts disposed on the processing cartridge 3, thereby ensuring the service life of the bias contacts. Further, the photosensitive drum bias contact 331 and the charging roller bias contact 371 on the drum holder 34 may be located at a lower position and a upper position of the drum holder 34, respectively, and the developing roller bias contact 391 and the toner feeding roller bias contact 381 on the frame 35 of the developing cartridge 32 may be close to the center position of the frame 35. As such, the thrust of the bias contacts that the photosensitive drum cartridge 31 and the developing cartridge 32 receive may be more evenly balanced.

Figure 10:
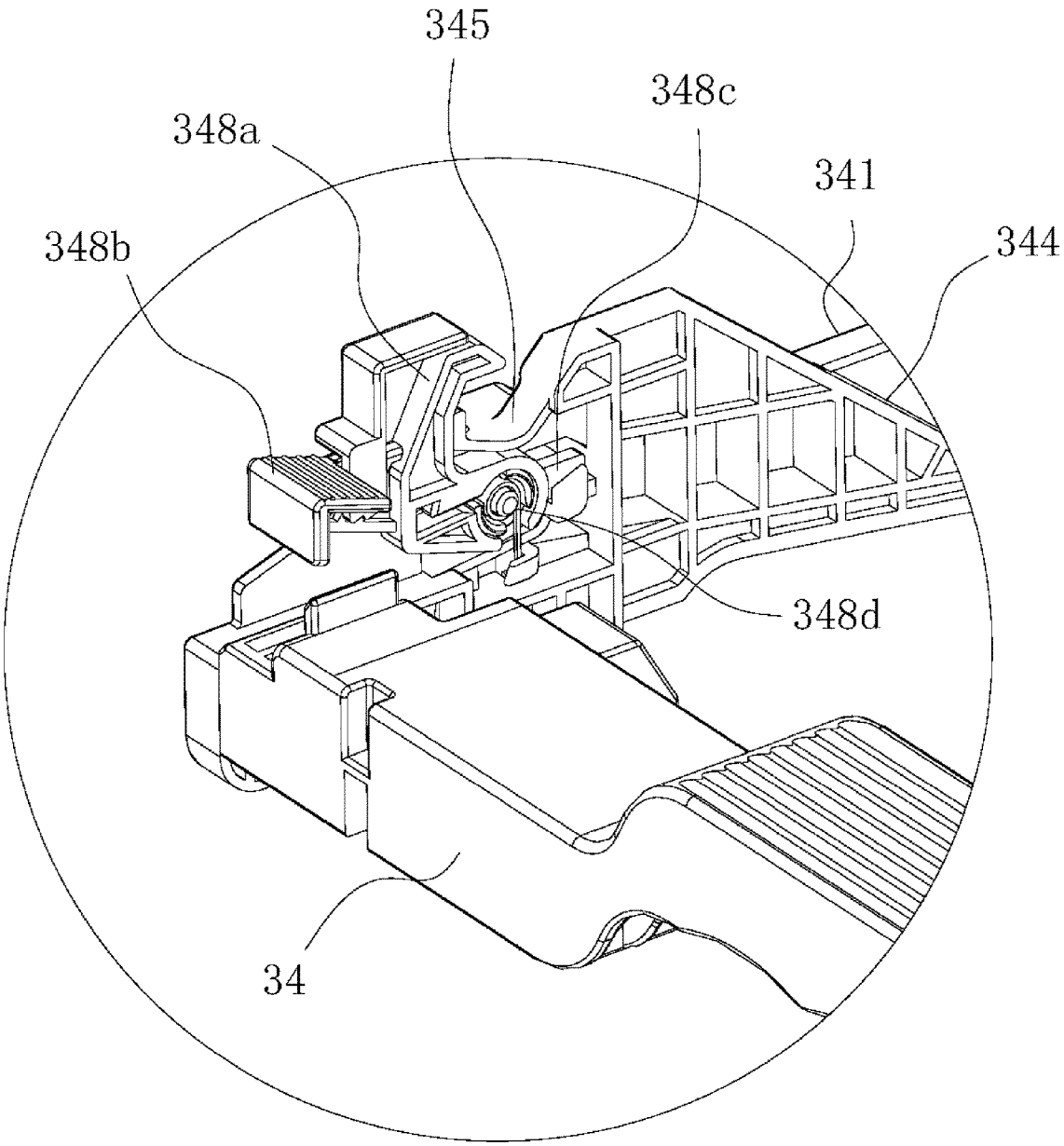
FIG. 10 illustrates a schematic structural view of a locking component on a photosensitive drum cartridge according to some embodiments of the present disclosure.

Installation and Cooperation of the Photosensitive Drum Cartridge and the Developing Cartridge Referring to FIG. 10 as well as FIG. 4 and FIG. 7, when the developing cartridge 32 and the photosensitive drum cartridge 31 are mounted together, the user may hold the rear handle of the developing cartridge 32, align the guided section 351 of the developing cartridge 32 with the guiding section 344 on the photosensitive drum cartridge 31, and slide the guided section 351 along the guiding section 344. When the developing cartridge 32 slides to a position where the developing roller 39 touches the photosensitive drum 33, the developing cartridge 32 may not be able to move further. At this time, the user may hold the developing cartridge 32 and rotate the developing cartridge 32 with the guided section 351 as a rotating axis, such that the rear end of the developing cartridge 32 may fall into the photosensitive drum cartridge 31. That is, the supported element 352 may fall into the supporting part 345 in a rotating manner. As such, friction between the supported element 352 and the supporting part 345 may be avoided, improving the operability of the developing cartridge installation.

Prior to installing the processing cartridge 3 into the image forming apparatus 1, in order to fix the developing cartridge 32 onto the photosensitive drum cartridge 31 and prevent the developing cartridge 32 from being detached, a locking component may be further disposed on the drum holder 34. The locking component may include a locking pole, and the locking pole may be mounted on the drum holder 34 through a hinge. A locking hook portion 348*a*, a pressing portion 348*b*, and a positioning portion 348*c* may be integrally formed on the locking pole. The locking component may also include a locking torsion spring 348*d*. On end of the locking torsion spring 348*d* may be snapped onto the drum holder 34, and the other end may be snapped onto the locking pole.

After the developing cartridge 32 is mounted in position, under the action of the locking torsion spring 348*d*, the locking hook portion 348*a* may block the return path of the developing cartridge 32, thereby preventing the developing cartridge 32 from being detached from the photosensitive drum cartridge 31. The positioning portion 348*c* may abut against the drum holder 34, and thus fix the position of the locking pole. The locking hook portion 348*a* may abut against the developing cartridge at any position. The present disclosure provides an embodiment in which the supported element 352 of the developing cartridge 32 is locked by a locking pole. When the photosensitive drum cartridge 31 needs to be taken out from the developing cartridge 31, the user may press the pressing portion 348*b* to release the locking of the supported element 352 by the locking pole, and thus the developing cartridge 32 may be easily taken out. In the meantime, the locking torsion spring 348*d* may generates an elastic restoring force, and when the user releases the pressing portion 348*b*, the locking pole may be automatically reset.

Installation and Cooperation of the Processing Cartridge and the Image Forming Apparatus Referring to FIG. 2, FIG. 4, FIG. 5, and FIG. 7, after the developing cartridge 32 and the photosensitive drum cartridge 31 are mounted and fixed, the user may hold the rear end of the processing cartridge 3 to insert the processing cartridge 3 into the image forming apparatus along the direction-guiding sections 71 that are disposed on the two sidewalls inside the main body 7. Because one or more position-limiting protrusions 342 may be disposed on the outer side of the drum sidewalls, when the position-limiting protrusions 342 move to the far end of the direction-guiding sections 71, the processing cartridge 3 may not be able to move forward. According to the present disclosure, as long as the position-limiting protrusion 342 can abut against the direction-guiding section 71, the position-limiting protrusion 342 may be a structure having any appropriate shape. In one embodiment, the cross section of the position-limiting protrusion 342 may have a circular ring shape, and may be disposed around the axis of the photosensitive drum 33. Based on such a structure, the outer diameter of the position-limiting protrusion 342 may be the same as the width of the far end of the direction-guiding section 71, such that the processing cartridge 3 may be prevented from jumping along the longitudinal direction. Therefore, through the cooperation between the position-limiting protrusion 342 and the direction-guiding section 71, when the processing cartridge 3 is mounted in position, the displacement of the front end of the processing cartridge 3 in the three directions may be limited, such that the installation accuracy of the processing cartridge 3 may be improved. Disposing the circular-ring-shaped position-limiting protrusion 342 to surround the photosensitive drum driving head 332 may also be able to provide protection for the photosensitive drum driving head 332. As such, the photosensitive drum driving head 332 may be prevented from being collided during the process of mounting the processing cartridge 3. Moreover, when the processing cartridge 3 is placed outside of the image forming apparatus 1, the photosensitive drum driving head 332 may be prevented from being collided by external objects.

In one embodiment, in order to ensure that the mounting of the processing cartridge 3 in the image forming apparatus is more stable while providing thrust to keep the developing roller 39 in contact with the photosensitive drum 33, a force-applying component 72 may be disposed on the sidewall of the direction-guiding section 71 to provide a pushing force to the processing cartridge 3. The force-applying component 72 may preferably be a torsion spring. Alternatively, the force-applying component 72 may be a thrust spring. The force-applying component 72 may include two abutting portions 72*c* located on the two ends, respectively, and a force-applying portion connected the two abutting portions 72*c*. The abutting portion 72*c* may abut against the main body 7, and the force-applying portion may further include an inclined introduction side 72*a* and an inclined pressing side 72*b*. Compared to the pressing side 72*b*, the introduction side 72*a* may be closer to the upstream position of the installation direction of the processing cartridge 3. In addition, the inclination direction of the introduction side 72*a* may be opposite to the inclination direction of the pressing side 72*b*. The direction of the force applied by the pressing side 72*b* may be along the installation direction of the developing cartridge 32.

In order to achieve the object of the present disclosure, the force-applying component 72 may apply thrust force to any position of the developing cartridge 32. However, since the force that the force-applying component 72 applies to the processing cartridge 3 may be large, in one embodiment, in order to make the force applied on the processing cartridge 3 more stable, and reduce the generation of rotational torque, the force-applying component 72 may apply the force on the supported element 352, such that the force that the force-applying component 72 applies to the developing cartridge 32 and the processing cartridge 3 may be at a position closer to the side-end of the processing cartridge 3. During the installation of the processing cartridge 3, the supported element 352 may first come into contact with the introduction side 72*a* of the force-applying component 72, and may push the force-applying component 72 to be deformed. When the supported element 352 passes over the joint of the introduction side 72*a* and the pressing side 72*b*, the force-applying component 72 may be pressed downward under the effect of its own elastic resilience, and may apply a force to the supported element 352 through the pressing side 72*b*. The force may generate a forward component and a downward component. The forward component may force the developing roller 39 in contact with the photosensitive drum 33, and the downward component may force the supported element 352 to press the drum sidewall 341 of the drum holder 34. As such, the entire processing cartridge 3 may be pressed into the main body 7, so that the processing cartridge 3 may be stably installed.

As described above, through the cooperation between the position-limiting protrusion 342 and the direction-guiding section 71, after the processing cartridge 3 is mounted in position, the displacement of the front end of the processing cartridge 3 in the three directions may be limited. That is, displacement in the forward direction as well as in the upper and the lower directions may be limited. In order to further improve the mounting stability of the processing cartridge 3, the present disclosure also provides a structure for preventing the processing cartridge 3 from retracting back. For example, a support wall 349 may be disposed on the bottom portion of the drum sidewall 341 of the drum holder 34, and a support groove 73 may be disposed on the lower portion of the sidewall of the direction-guiding section 71 of the main body 7. The support groove 73 may be lower than the lower guiding surface of the direction-guiding section 71. During the installation of the processing cartridge 3, the support wall 349 may be in contact with the lower guiding surface of the direction-guiding section 71, and may slide along the lower guiding surface. After the processing cartridge 3 is mounted in position, the processing cartridge 3 may not be able to move forward, and the support wall 349 may be moved to a position just matching the support groove 73. The user may hold the rear end of the processing cartridge 3, and rotate the processing cartridge 3 downward using the axis of the photosensitive drum 33 as a rotation center, such that the support wall 349 may be able to fall into the support groove 73. Under the action of the downward force of the force-applying component 72, the support wall 349 may be always held in the support groove 73, and the processing cartridge 3 may not be detached easily from the main body 7.

Further, when the processing cartridge 3 is viewed from a direction perpendicular to the axis of the photosensitive drum 33, the supported element 352 may be overlapped with at least a portion of the support wall 349. Through this arrangement, the downward force that the force-applying component 72 applies to the supported element 352 may be directly transferred to the drum sidewall 341, and may further be transferred to the direction-guiding section 71 from the drum sidewall 341 through the support wall 349. Therefore, the downward force may be transferred in a substantially straight line without generating additional torque, so that the processing cartridge 3 may be more stable. In addition, when the processing cartridge 3 is viewed from the direction parallel to the axis of the photosensitive drum 33, the support wall 349 may also be as close as possible to the supported element 352.

Further, a support bevel 73*a* may be disposed on the bottom portion of the support groove 73. The support bevel 73*a* may have a slope in a direction toward the photosensitive drum 33. When the support wall 349 is installed into the support groove 73, the support wall 349 may be in contact with the support bevel 73*a*. Under the joint action of the sloping guidance of the support bevel 73*a* and the force-applying component 72, the processing cartridge 3 may be pushed forward, such that the mounting accuracy of the processing cartridge 3 may be higher.

Because the photosensitive drum cartridge 31 and the developing cartridge 32 are both consumables, the developing cartridge 32 may need to be replaced after the toner in the developing cartridge 32 is used up, and when the waste toner stored in the photosensitive drum cartridge 31 reaches a certain amount, the photosensitive drum cartridge 31 may need to be replaced. Therefore, a storage unit may be disposed on each of the photosensitive drum cartridge 31 and the developing cartridge 32. For example, a first storage unit 311 (referring to FIG. 4) and a second storage unit 321 (referring to FIG. 11) may be disposed on the photosensitive drum cartridge 31 and the developing cartridge 32, respectively for storing information such as the toner amount, the printing amount, etc.

According to the present disclosure, the first storage unit 311 may be disposed above the waste-toner box, and the second storage unit 321 may be disposed under the developing cartridge 32. Correspondingly, contacts corresponding the two storage units may be respectively disposed inside the image forming apparatus 1. After the contacts are in contact with the storage units, electrical connection may be established, and the information in the storage units may thus be read and rewritten as the printing operation proceeds. Among these contacts, a plurality of first contacts 22 connected to the first storage unit 311 may be disposed under an exposure holder 21, and a plurality of second contacts 41 connected to the second storage unit 321 may be disposed above the transport unit 4.

In the conventional technology, when the processing cartridge 3 is mounted inside the image forming apparatus 1, each storage unit and the corresponding contacts may be in contact with each other as the processing cartridge 3 slides, that is, sliding friction may be generated, since the contacts are all elastic structures, long-term sliding-friction contact can cause the conductive layer on the storage unit to be worn which, together the adhesion of the toner particles, can easily lead to poor communication.

According to the present disclosure, in one embodiment, as described above, when the processing cartridge 3 is mounted on the far end of the direction-guiding section 71, the processing cartridge 3 can also be rotated with the axis of the photosensitive drum 33 as a rotation axis. In the view from the axis of the photosensitive drum 33, the first storage unit 311 and the second storage unit 321 may be respectively located on the two opposite sides of the axis of the photosensitive drum 33, that is, the first storage unit 311 and the second storage unit 321 may be located on the front end and the rear end of the processing cartridge 3, respectively. In addition, the first storage unit 311 and the second storage unit 321 may further be disposed on the upper surface and the lower surface of the processing cartridge 3, respectively. Therefore, during the process of mounting the processing cartridge 3 to the image forming apparatus 1, the first storage unit 311 and the second storage unit 321 may not need to be in sliding contact, and when the processing cartridge 3 is slid to the far end of the direction-guiding section 71, the processing cartridge 3 may be rotated around the axis of the photosensitive drum 33 to finally bring the first storage unit 311 to be in contact with the first contact 22 and the second storage unit 321 to be in contact with the second contact 41, thereby avoiding sliding friction between the contacts and the storage units.

The Forces Applied to the Processing Cartridge

Figure 12:
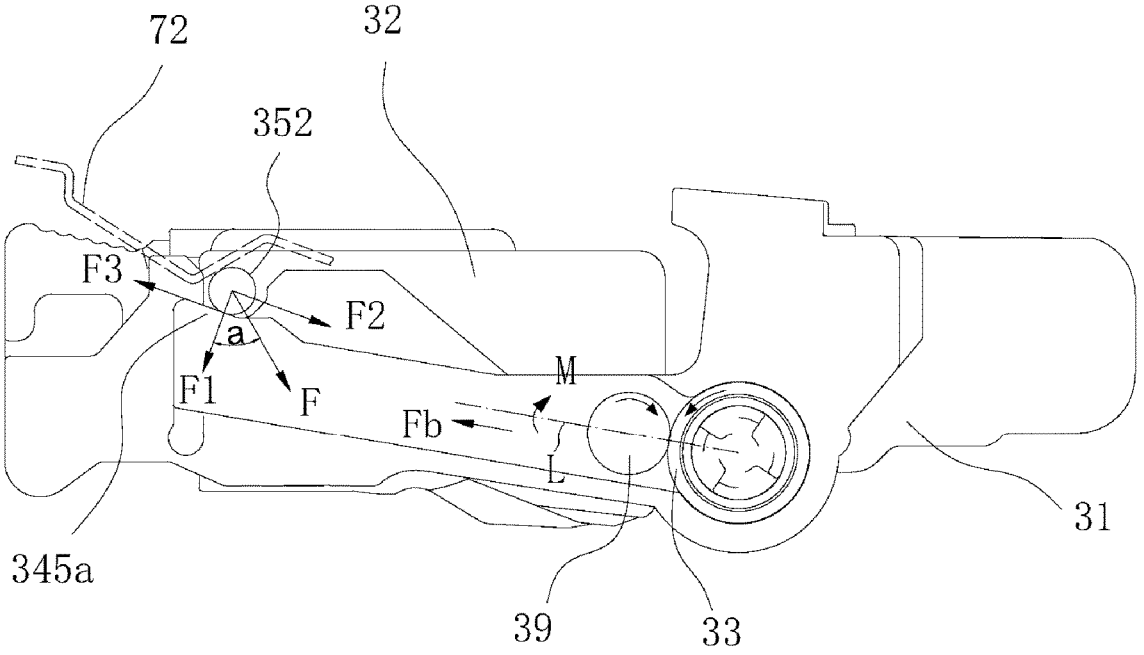
FIG. 12 illustrates a schematic diagram of an analysis of forces applied on a processing cartridge according to some embodiments of the present disclosure.

In the following, the force-balanced state in the case that the processing cartridge 3 is mounted inside the image forming apparatus 1 will be described with reference to FIG. 12. Because the surface of the developing roller 39 is elastic, after the processing cartridge 3 is mounted inside the image forming apparatus 1, the developing roller 39 and the photosensitive drum 33 may need to be closely in contact with each other during operation to keep a clamping interface N formed between the developing roller 39 and the photosensitive drum 33. The clamping interface N may ensure that the toner on the developing roller 39 can be efficiently transferred to the surface of the photosensitive drum 33 to prevent deterioration of image quality. However, in this case, the developing roller 39 may also receive a backward retracting force Fb, forcing the developing cartridge 32 to have a tendency to move backward, such that the area of the clamping interface N sandwiched between the developing roller 39 and the photosensitive drum 33 may become smaller, and the clamping force may be reduced.

Moreover, when the photosensitive drum 33 receives a driving force from the main body 7 and starts rotation, the developing roller 39 may rotate together with the photosensitive drum 33. In the direction of a line L that connects the axis of the photosensitive drum 33 to the axis of the developing roller 39, a rotational moment M may be generated. The rotational moment M may force the rear end of the developing cartridge 32 to have a tendency to swing upward using the guided section 351 as a fulcrum. The rotational moment M may also cause the developing cartridge 32 to retract back, such that the area of the clamping interface N sandwiched between the developing roller 39 and the photosensitive drum 33 may become smaller.

When the two cases described above simultaneously take place, it may be difficult to maintain an effective contact between the developing roller 39 and the photosensitive drum 33, which may cause the printed image to become blurred. Moreover, when the image forming apparatus 1 is in the operation state, the installation of the developing cartridge 32 may become more unstable.

In order to solve the above problem, according to the present disclosure, the supported element 352 disposed at the end of the developing cartridge 32 may receive a tilted downward force F from the force-applying component 72 on the side of the main body 7, so that the supported element 352 may abut against a supporting part 345*a* of the drum sidewall 341. Under the action of the gravity of the developing cartridge 32 and the force F of the force-applying component 72, the supported element 352 may apply the force F to the supporting part 345*a*. The force F applied by the force-applying component 72 can be divided into a first force F1 that is perpendicular to the supporting part 345*a* and a second force F2 that is parallel to the supporting part 345*a*. The direction of the first force F1 may be the same as the normal direction of the contact interface between the supported element 352 and the supporting part 345*a*.

Because the supported element 352 has a certain distance from the guided section 351, under the action of the first force F1, the developing cartridge 32 may generate a downward rotational moment, which may be able to counteract the upward rotational moment M generated when the photosensitive drum 33 drives the developing roller 39 to rotate. In the meantime, under the action of the second force F2, the backward retracting force Fb of the developing roller 39 may also be counteracted.

In addition, although the second force F2 provides a forward thrust, because the supported element 352 is in contact with the supporting part 345*a*, the supporting part 345*a* may simultaneously generate a backward counterforce F3 to the supported element 352, preventing the supported element 352 from moving forward. As such, the effect of the second force F2 may be reduced, and the clamping effect between the developing roller 39 and the photosensitive drum 33 cannot be guaranteed. To this end, the present disclosure sets the pressing direction of the force-applying component 72. For example, the angle α between the direction of the force F and the normal direction of the contact interface between the supported element 352 and the supporting part 345*a* may not be less than the friction angle ø between the supported element 352 and the supporting part 345*a*. The friction angle ø is measured between the normal force and resultant force, that is attained when failure just occurs in response to a shearing stress. When the materials of the supported element 352 and the supporting part 345*a* are determined, the friction angle between the two may also be determined.

When the angle between the direction of the force F applied by the force-applying component 72 and the normal direction of the contact interface between the supported element 352 and the supporting part 345*a* is not less than the friction angle, the second force F2 can provide a reliable forward thrust to overcome the reverse counterforce F3 applied to the supported element 352 by the supporting part 345*a* and the retracting force Fb of the developing roller 39. Therefore, the clamping effect between the developing roller 39 and the photosensitive drum 33 may be ensured, and thus the imaging quality of the image forming apparatus 1 may be ensured.

The above describes the forces applied to the processing cartridge 3 in a case where the supporting part 345*a* (referring to FIG. 12) has a flat surface. In the following, the forces applied to the processing cartridge 3 in a case that the supporting part 345 has a curved surface will be described.

Figure 13:
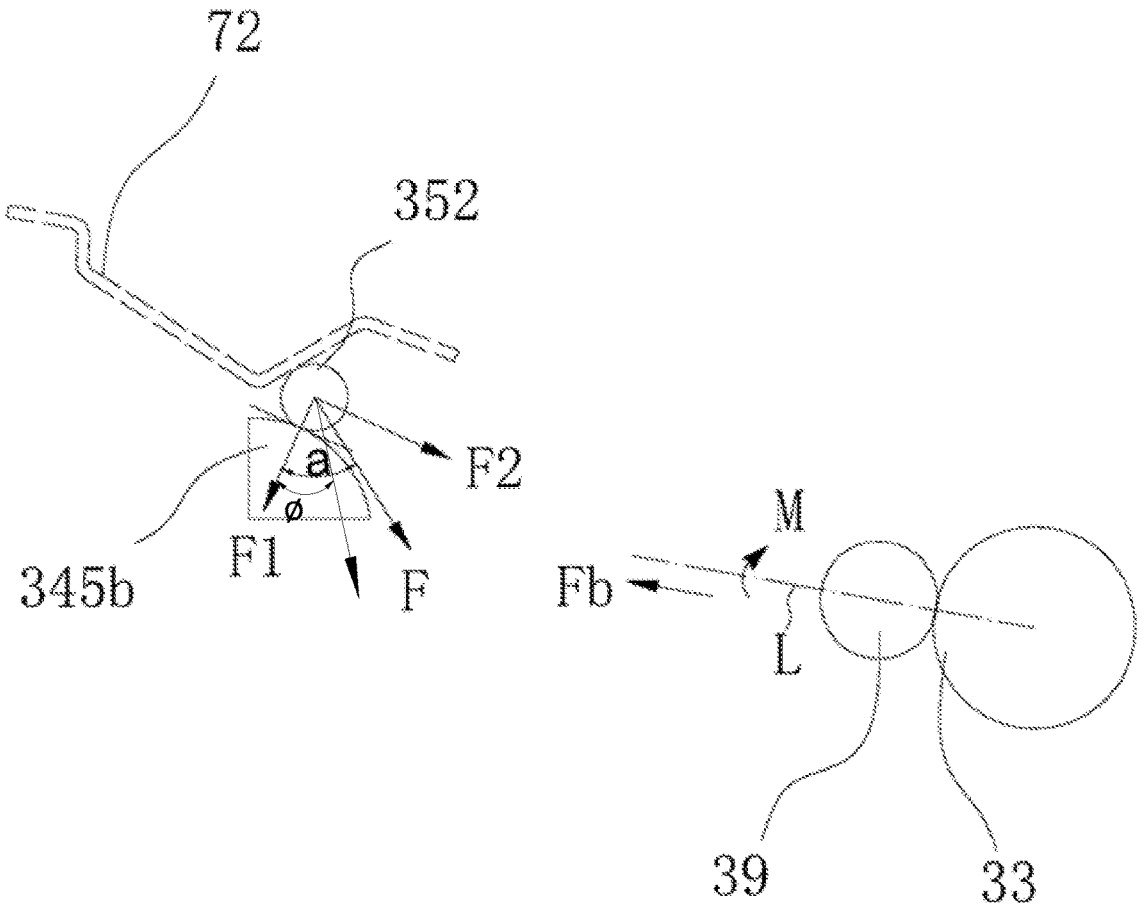
FIGS. 13-15 illustrate schematic diagrams of an analysis of forces applied on another processing cartridge according to some embodiments of the present disclosure.
Figure 14:
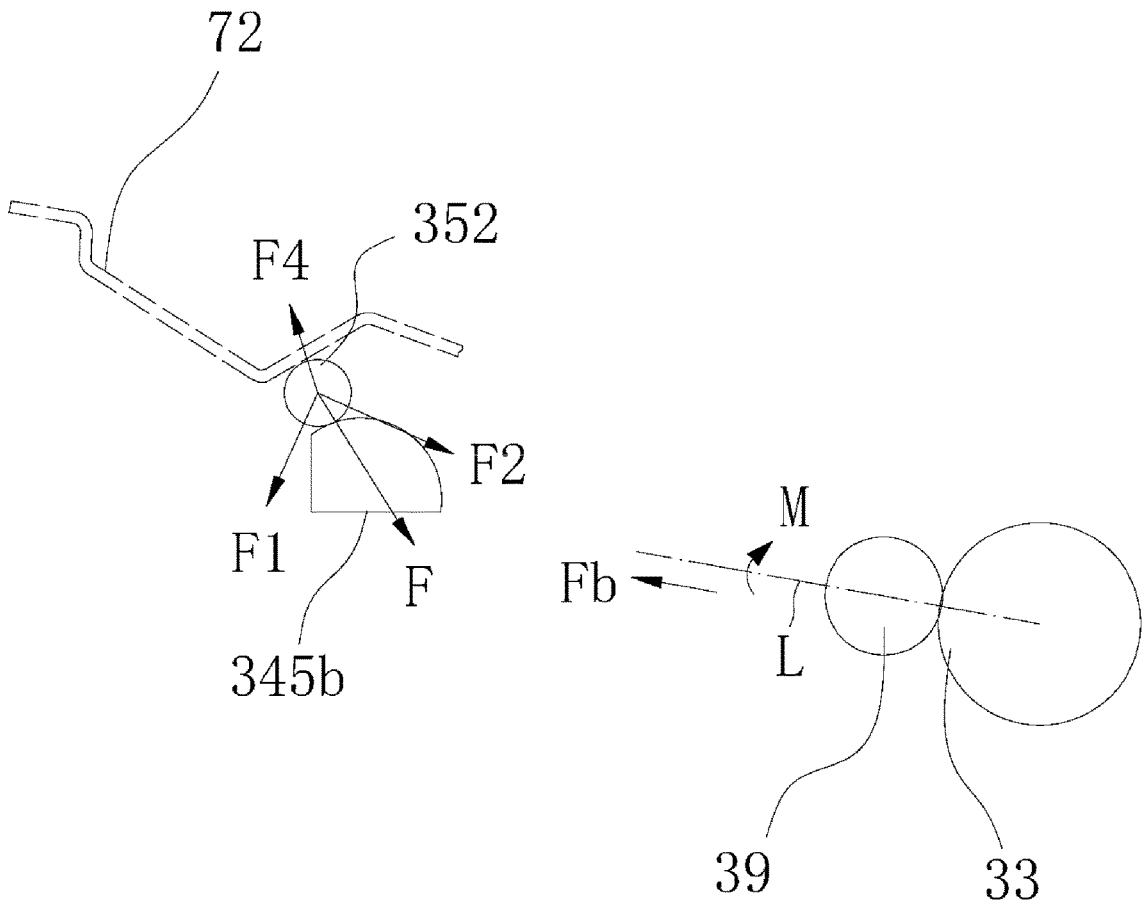
Figure 15:
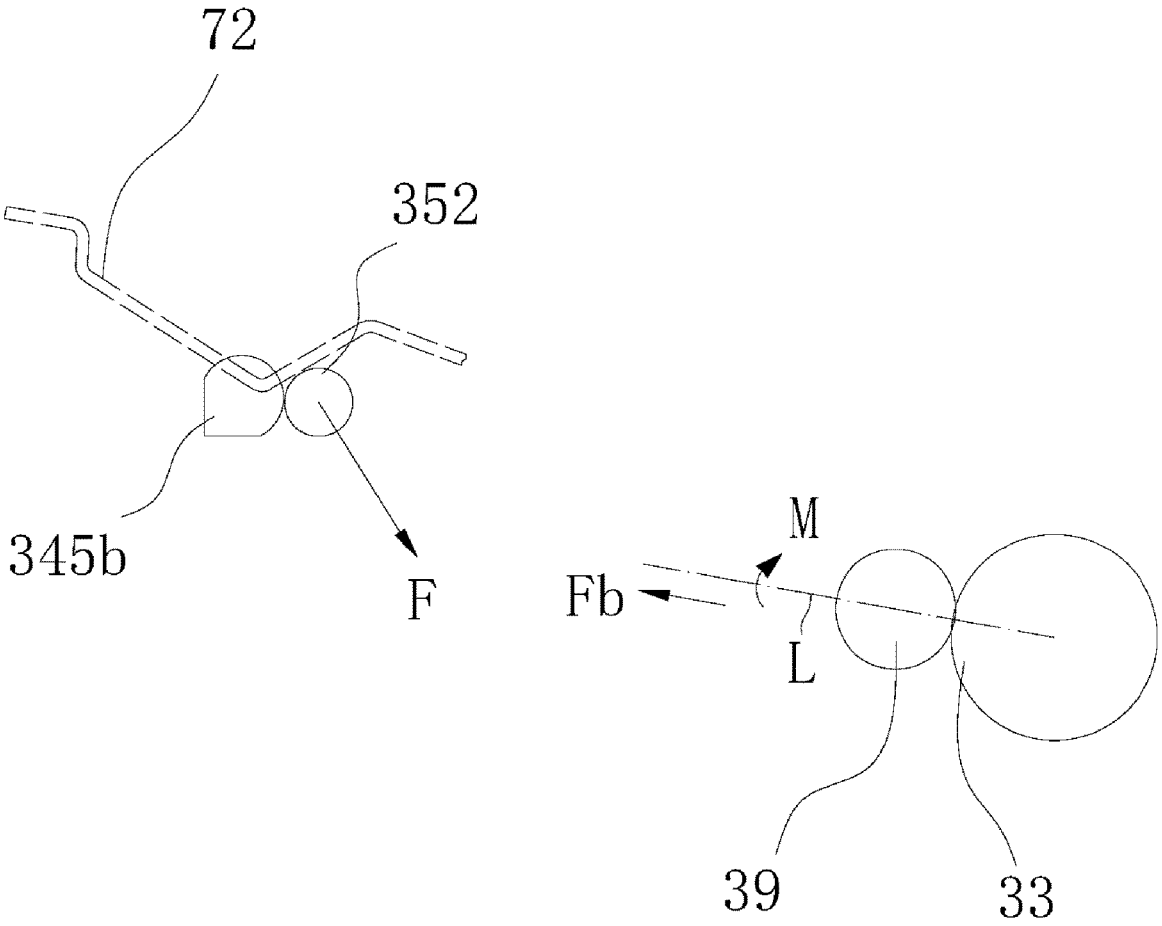

Referring to FIGS. 13-15, the supported element 352 may be in contact with a supporting part 345*b* at any position of the supporting part 345*b* and may have a curved contact interface. Unlike that of the supporting part 345*a* with a flat surface (referring to FIG. 12), the normal and tangential directions of the curved contact interface at different positions may be different. For this reason, it may be necessary to define an effective working area on the curved supporting part 345*b*, such that the supported element 352 can receive the force F from the force-applying component 72, and generate a first force F1 and a second force F2.

At a first end of the working area described above, as shown in FIG. 14, the supporting part 345*b* may apply a counterforce F4 to the supported element 352. When the direction of the counterforce F4 is toward the supported element 352, the forward tendency of the supported element 352 may be limited, and even the developing cartridge 32 may not be able to move forward, such that the clamping effect between the developing roller 39 and the photosensitive drum 33 may not be guaranteed. Therefore, at the first end of the working area, such a counterforce F4 may need to be avoided. At the other end, i.e., a second end of the working area, as shown in FIG. 15, the supporting part 345*b* may not generate a counterforce to the supported element 352. In this case, the supported element 352 and the supporting part 345*b* may be detached from each other, and thus the first force F1 and the second force F2 may not take place, and the mounting stability of the developing cartridge 32 and the processing cartridge 3 may not be ensured. Therefore, the detachment of the supported element 352 from the supporting part 345 needs to be avoided. In one embodiment, the received forces are described based on a convex shaped surface of the supporting part 345*b*, in other embodiments, the curved surface of the supporting part 345*b* may have a concave shape.

Through the cooperation of the force-applying component 72, the supported element 352, and the supporting part 345 of the present disclosure, the mounting stability of the developing cartridge 32 and the processing cartridge 3 can be effectively ensured, and the thrust applied to the developing cartridge 32 by the pushing component can be reduced, thereby avoiding excessively large local stress. In addition, the developing roller 39 may be maintained in contact with the photosensitive drum 33 to ensure the image quality. However, since the second storage unit 321 is disposed at a position of the bottom portion of the developing cartridge 32 that is away from the toner outlet 353, the second storage unit 321 may be in contact with and electrically connected to the second contact 41 on the side of the main body 7. In order to ensure desired contact between the two, the second contact 41 may be configured to have an elastic structure, such as a torsion spring. Therefore, when the processing cartridge 3 is mounted on the main body 7, the second contact 41 may apply an upward force to the second storage unit 321.

Figure 11:
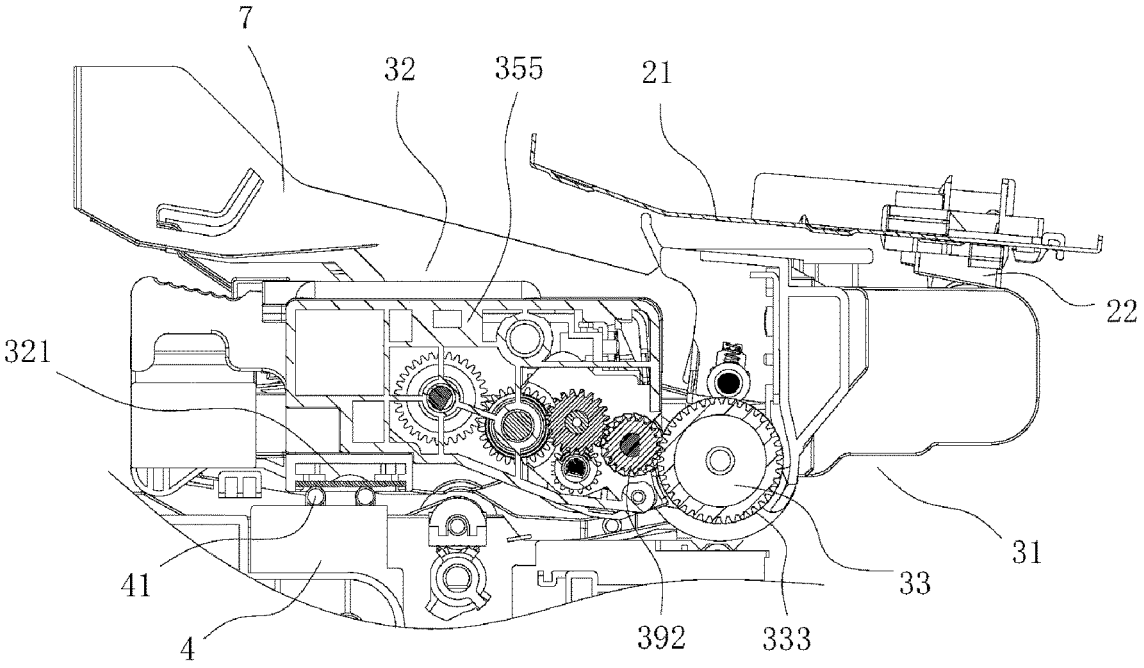
FIG. 11 illustrates a schematic cross-sectional view of an image forming apparatus in a direction perpendicular to the axis of a photosensitive drum and passing through a second storage unit according to some embodiments of the present disclosure.

As shown in FIGS. 7 and 11, in order to make the forces applied to the processing cartridge 3 more balanced and to avoid unnecessary rotational torque, the storage unit, the photosensitive drum driving gear 333, the guided section 351, and the supported element 352 may be located on the same side of the developing cartridge 32. In addition, preferably, when the developing roller 39 is viewed from a direction perpendicular to the axis of the developing roller 39, the second storage unit 321 may be overlapped with at least a portion of the developing roller driving gear 392 and the photosensitive drum driving gear 333. As such, the second storage unit 321 may be closer to the side of the processing cartridge 3, and the distance from the support wall 349 may be as small as possible. The upward rotational torque on the second storage unit 321 generated by the second contact 41 may be limited as much as possible.

When the developing cartridge 32 is provided with an end cap 355, the second storage unit 321 should also be disposed as close as possible to the end cap 355. Preferably, the second storage unit 321 may be disposed under the end cap 355, or may be a slot integrally formed on the end cap 355 for mounting the second storage unit 321, such that the second storage unit 321, the developing roller driving gear 392, and the photosensitive drum driving gear 333, the end cap 355 may be at least partially overlapped to achieve the object of reducing the upward rotational torque on the second storage unit 321 generated by the second contact 41.

The above are only the preferred embodiments of the present disclosure, and are not intended to limit the present disclosure. Any modifications, equivalents, improvements, etc., that are within the spirit and scope of the present disclosure, shall be included in the scope of protection of the present disclosure.

The above detailed descriptions only illustrate certain exemplary embodiments of the present disclosure, and are not intended to limit the scope of the present invention. Those skilled in the art can understand the specification as whole and technical features in the various embodiments can be combined into other embodiments understandable to those persons of ordinary skill in the art. Any equivalent or modification thereof, without departing from the spirit and principle of the present disclosure, falls within the true scope of the present disclosure.

What is claimed is:

1. A developing cartridge, detachably mounted on a photosensitive drum cartridge, the photosensitive drum cartridge being detachably mounted inside an image forming apparatus, comprising:
- a frame and a developing roller mounted on the frame, wherein:
  - the image forming apparatus further includes a force-applying component for applying a force to the developing cartridge;
  - the photosensitive drum cartridge includes a drum holder and a photosensitive drum mounted on the drum holder, wherein at least one sidewall of the drum holder is provided with a supporting part for mounting the developing cartridge;
  - at least one side-end surface of the frame of the developing cartridge is provided with a supported element cooperating with the supporting part; and
  - when the developing cartridge and the photosensitive drum cartridge are mounted inside the image forming apparatus, the supported element receives a force applied by the force-applying component such that the developing roller is maintained pressed against the photosensitive drum, wherein:
    - an angle between a direction of the force and a normal direction of a contact interface between the supported element and the supporting part is larger than or equal to a friction angle between the supported element and the supporting part.

2. The developing cartridge according to claim 1, wherein:
- the direction of the force applied by the force-applying component is toward a mounting direction of the developing cartridge.

3. The developing cartridge according to claim 1, wherein:
- the supporting part has a flat surface or a curved surface.

4. The developing cartridge according to claim 1, further including a storage unit disposed on a bottom portion of the frame, wherein:
- a driving gear is mounted on an axial end of the developing roller;
- the storage unit, the driving gear, and the supported element are located on a same side of the developing cartridge; and
- when the developing cartridge is viewed from a direction perpendicular to an axis of the developing roller, the storage unit is overlapped with at least a portion the driving gear.

5. The developing cartridge according to claim 4, wherein:
- a guided section is disposed on the at least one side-end surface of the frame, and the storage unit, the driving gear, the guided section, and the supported element are located on the same side of the developing cartridge.

6. The developing cartridge according to claim 5, wherein:
- when the guided section is viewed from a direction parallel to the axis of the developing roller, the guided section is overlapped with at least a portion of the developing roller.

7. The developing cartridge according to any of claim 5, further including an end cap disposed at an end of the developing cartridge, wherein:
- the guided section and the supported element are disposed on the end cap; and
- when the developing cartridge is viewed from a direction perpendicular to the axis of the developing roller, the storage unit, the driving gear, and the end cap are at least partially overlapped with each other.

8. A processing cartridge, detachably mounted inside an image forming apparatus, comprising:
- a photosensitive drum cartridge; and
- a developing cartridge, wherein:
  - the photosensitive drum cartridge includes a drum holder and a photosensitive drum mounted on the drum holder, wherein at least one sidewall of the drum holder is provided with a supporting part for mounting the developing cartridge;
  - the developing cartridge is configured to be detachably mounted on the drum holder, the developing cartridge including a frame and a developing roller mounted on the frame, wherein at least one side-end surface of the frame is provided with a supported element cooperating with the supporting part of the photosensitive drum; and
  - when the processing cartridge is mounted inside the image forming apparatus, the supported element receives a force applied by a force-applying component in the image forming apparatus, such that the developing roller is maintained pressed against the photosensitive drum, wherein:
    - an angle between a direction of the force and a normal direction of a contact interface between the supported element and the supporting part is larger than or equal to a friction angle between the supported element and the supporting part.

9. The processing cartridge according to claim 8, wherein:

a support wall is disposed on a bottom portion of each sidewall of the drum holder, and under the supporting part; and when the processing cartridge is mounted inside the image forming apparatus, the support wall abuts against a direction-guiding section disposed inside the image forming apparatus.

10. The processing cartridge according to claim 9, wherein:

a position-limiting protrusion is disposed on a front end of each sidewall of the drum holder, wherein the position-limiting protrusion has a circular ring shape and is arranged concentrically with an axis of the photosensitive drum.

11. An image forming apparatus, comprising:

a main body, wherein a direction-guiding section is disposed in the main body;

a processing cartridge, detachably mounted on the main body along the direction-guiding section, and including a photosensitive drum cartridge and a developing cartridge, wherein:

the photosensitive drum cartridge includes a drum holder and a photosensitive drum mounted on the drum holder, wherein at least one sidewall of the drum holder is provided with a supporting part for mounting the developing cartridge;

the developing cartridge is detachably mounted on the drum holder, and includes a frame and a developing roller mounted on the frame, wherein at least one side-end surface of the frame is provided with a supported element cooperating with the supporting part; and a force-applying component is disposed in the main body for applying a force to the developing cartridge, wherein:

when the processing cartridge is mounted on the main body, the developing roller is maintained pressed against the photosensitive drum; and an angle between a direction of the force and a normal direction of a contact interface between the supported element and the supporting part is larger than or equal to a friction angle between the supported element and the supporting part.

12. The image forming apparatus according to claim 11, wherein:

a support wall is disposed on a bottom portion of each sidewall of the drum holder, and under the supporting part; and a support groove cooperating with the support wall is disposed on the direction-guiding section.

13. The image forming apparatus according to claim 12, wherein:

a support bevel abutting against the support wall is disposed on a bottom portion of the support groove.

14. The image forming apparatus according to claim 12, wherein:

when the processing cartridge is view from a direction perpendicular to an axis of the photosensitive drum, the supported element is overlapped with at least a portion of the support wall.

* * * * *